United States Patent [19]

Pane

[11] Patent Number: 4,750,661

[45] Date of Patent: Jun. 14, 1988

[54] APPARATUS FOR APPLYING STAPLES TO GROUPS OF SIGNATURES AND THE LIKE

[75] Inventor: Mario Pane, Trino, Italy

[73] Assignee: Officine Meccaniche Giovani Cerutti S.p.A., Casale Monferroto, Italy

[21] Appl. No.: 873,803

[22] Filed: Jun. 13, 1986

[30] Foreign Application Priority Data

Jun. 14, 1985 [IT] Italy ..... 21159 A/85.

[51] Int. Cl.[4] ..... B25C 7/17

[52] U.S. Cl. ..... 227/7; 227/1; 227/78; 227/81

[58] Field of Search ..... 227/1, 7, 78, 81

[56] References Cited

U.S. PATENT DOCUMENTS 3,120,664 2/1964 Mott ..... 227/1

3,279,671 10/1966 Bachman, Jr. et al. ..... 227/1

3,758,015 9/1973 Stanton ..... 227/7

4,318,555 3/1982 Adamski et al. ..... 227/78 X 4,512,506 4/1985 Fischer ..... 227/81 X

*Primary Examiner*—Paul A. Bell

*Attorney, Agent, or Firm*—Peter K. Kontler

[57] ABSTRACT

Apparatus which applies staples to groups of sheets at the discharge end of a rotary printing press has a rotary conveyor which transports the groups of sheets past a stapling station where the groups are provided with pairs of staples. If one of the two regular stapling units is out of commission, an auxiliary stapling unit is started in response to detected absence of two staples in each finished product so that the groups of sheets receive pairs of staples while the defective stapling unit is being inspected, repaired or replaced.

20 Claims, 3 Drawing Sheets

APPARATUS FOR APPLYING STAPLES TO GROUPS OF SIGNATURES AND THE LIKE

BACKGROUND OF THE INVENTION

The invention relates to improvements in apparatus for accumulating sheets of paper or the like into pamphlets, brochures, magazines or analogous printed products. More particularly, the invention relates to improvements in apparatus wherein sheets which are accumulated into groups having predetermined numbers of overlapping sheets are secured to each other by fasteners in the form of staples.

It is well known to install a staple-applying apparatus at the discharge end of a rotary printing press. The apparatus comprises a rotary gathering conveyor which receives from the press groups of sheets for transport along an endless path at a uniform distance from one another. The backs of the sheets (e.g., the backs of signatures) face radially outwardly so that they can be moved into register with suitable instrumentalities (called heads) which serve to apply U-shaped metallic staples. The staples are thereupon clinched to convert the groups of sheets into magazines, brochures or the like. The groups of sheets may but need not always have covers whose material is or may be stiffer or thicker than the material of the sheets. Reference may be had to the commonly owned copending patent application Ser. No. 872,615 filed June 10, 1986.

Conventional apparatus for the making of printed products from sheets which issue from a rotary printing press or another source normally comprise a rotary carrier of heads. The heads are caused to advance seriatim to a stapling station where they are in a position to apply staples to the oncoming groups of sheets on the gathering conveyor. The leader of a length of wire is advanced into the range of an oncoming head before the head reaches the stapling station, and the head severs a portion from the leader of the wire and converts the separated portion into a U-shaped staple which is ready to be applied to a group of sheets. In many heretofore known stapling apparatus, each group of sheets if provided with two staples at a selected distance from each other. Conventional staple forming and applying heads operate quite satisfactorily, even if the press turns out as many as and in excess of 50,000 groups of sheets per hour. However, once the staple forming and applying means must operate at such high frequencies, the wear upon the heads and upon the means for feeding wire to the heads is very pronounced so that the heads require frequent maintenance, repair or replacement. Even short lasting stoppage of such stapling apparatus or of the means for feeding groups of sheets to their heads entails substantial losses in output. The means for feeding wire into the range of orbiting or otherwise moving heads which are designed to form U-shaped staples and to apply the staples to oncoming groups of sheets on the gathering conveyor are particularly likely to undergo extensive wear and to fail to function properly with attendant losses in output. The application of a lesser number of staples to groups of sheets is not acceptable to many customers. Thus, if an apparatus is designed to apply two staples to each of a short or long series of groups of sheets, failure of one of the heads or of one of the wire feeding means entails the making of publications each of which has a single staple. This is unsatisfactory and, therefore, publications having single staples (instead of pairs of staples) must be discarded.

OBJECTS AND SUMMARY OF THE INVENTION

An object of the invention is to provide an apparatus which can provide each of a short or long series of groups of sheets with a requisite number of staples even if a regular staple applicator is out of commission.

Another object of the invention is to provide the apparatus with novel and improved means for applying requisite numbers of staples to each of a short or long series of groups of sheets regardless of the speed at which the groups are transported past the stapling station.

A further object of the invention is to provide an apparatus which can apply to each of a short or long series of groups of sheets a pair of staples even if one of the two regular staplers is idle.

An additional object of the invention is to provide an apparatus whose output exceeds the outputs of conventional apparatus and which can be repaired, inspected and/or furnished with spare parts while it continues to turn out brochures or like products of the type wherein the sheets or signatures are held together by predetermined numbers of staples.

Still another object of the invention is to provide a novel and improved method of applying to groups of sheets prescribed numbers of staples or analogous fasteners regardless of the speed at which the groups are transported past the stapling station or stations.

An additional object of the invention is to provide a production line for the making of brochures, magazines, pamphlets and like products which embodies the above outlined apparatus.

The apparatus of the present invention is utilized to apply staples or analogous fasteners to groups of sheets (e.g., to stacks of signatures) and comprises means (e.g., a drum- or turret-shaped conveyor which is rotated about a horizontal axis) for transporting a series of groups of sheets along a predetermined path, first staple applicator means arranged to apply staples to successive groups of sheets on the transporting means, second or auxiliary staple applicator means which is actuatable to apply staples to successive groups of sheets on the transporting means, means for monitoring the groups on the transporting means and for generating signals denoting the failure of the first applicator means to apply staples to the groups of sheets on the transporting means, and means for actuating the second applicator means in response to signals from the monitoring means.

The first applicator means can comprise a plurality (e.g., two sets) of applicator heads arranged to apply staples to successive groups of sheets on the transporting means and means for feeding metallic wire to the heads. The monitoring means then preferably comprises means for generating signals denoting the failure of at least one of the heads or at least one set of heads) to apply staples to the groups of sheets on the transporting means.

The second applicator means can comprise a single head (or a single set of, for example, four equidistant heads which are arranged to orbit along a preselected path) and a single wire feeding device which is actuatable or deactivatable by the actuating means.

The wire feeding means of the first and second applicator means can be mounted on a common support (e.g., on a substantially horizontal shaft), and at least one of the feeding means (particularly the feeding means of the second applicator means) can include a housing having a section which is movable (preferably pivotable) relative to the support between an operative position in which the respective head or heads can receive wire and an inoperative position in which the respective head or heads cannot receive wire from the associated feeding means.

The monitoring means can include one or more proximity detectors, one or more optical detectors or one or more otherwise constructed sensors or detectors which are or can be disposed at a level below the axis of the aforementioned conveyor of the transporting means.

The actuating means can comprise a microprocessor which has input means connected with the monitoring means and output means connected with the second applicator means. The apparatus can further comprise a manually operable key, knob or analogous element which is operable by an attendant to selectively interrupt the operation of at least one applicator means. For example, a key or knob can be provided to selectively deactivate the first applicator means (or at least one wire feeding device of the first applicator means), and the apparatus can further comprise lamps or other suitable means for displaying the signals to thus indicate the condition of the applicator means. A key can be used to start and interrupt the operation of the first applicator means or of one or more units of the first applicator means, for example, in order to allow for replacement of a supply of wire while the second applicator means is actuated to apply staples to successive groups of sheets during the interval of idleness of a unit of the first applicator means.

The second applicator means of the improved apparatus preferably comprises a single head or a single set of heads and a single wire feeding device which delivers increments of wire into the path of movement of the head or heads so that each head can sever a length of wire and convert the severed length into a substantially U-shaped staple which is transported toward the stapling station. As mentioned above, a section of the wire feeding device forming part of the second applicator means can be pivoted about a preferably horizontal axis between an operative position in which the head or heads can receive wire in response to signals from the monitoring means and an inoperative position in which the head or heads cannot receive wire regardless of whether the monitoring means transmit signals or do not transmit any signals. The wire feeding device of the second applicator means can comprise a first rotary shaft which is mounted in the movable section of the wire feeding device of the second applicator means, at least one wire feeding roller which is rotatable by the first shaft, a prime mover (e.g., a continuously driven worm) and means for transmitting torque from the prime mover to the shaft in response to signals from the actuating means (such torque transmitting means can be operated only when the aforementioned section of the wire feeding device is held in the operative position). The wire feeding device preferably includes a second section which can be rigidly secured to the support, and the torque transmitting means can include a second shaft which is rotatably mounted in the second section. The shafts have teeth which mate in the operative position of the movable section. The torque transmitting means can further comprise an electromagnetic clutch which is energizable in response to signals from the monitoring means to connect the prime mover with the second shaft. As mentioned above, the prime mover can comprise a driven worm, and the torque transmitting means can further comprise a worm wheel which meshes with the worm and is coupled to the second shaft in response to energization of the clutch. If desired, the electromagnetic clutch can be replaced with a different clutch which is engageable in response to signals from the monitoring means.

The worm can constitute a common prime mover for the wire feeding device of the second applicator means and the wire feeding devices of the first applicator means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
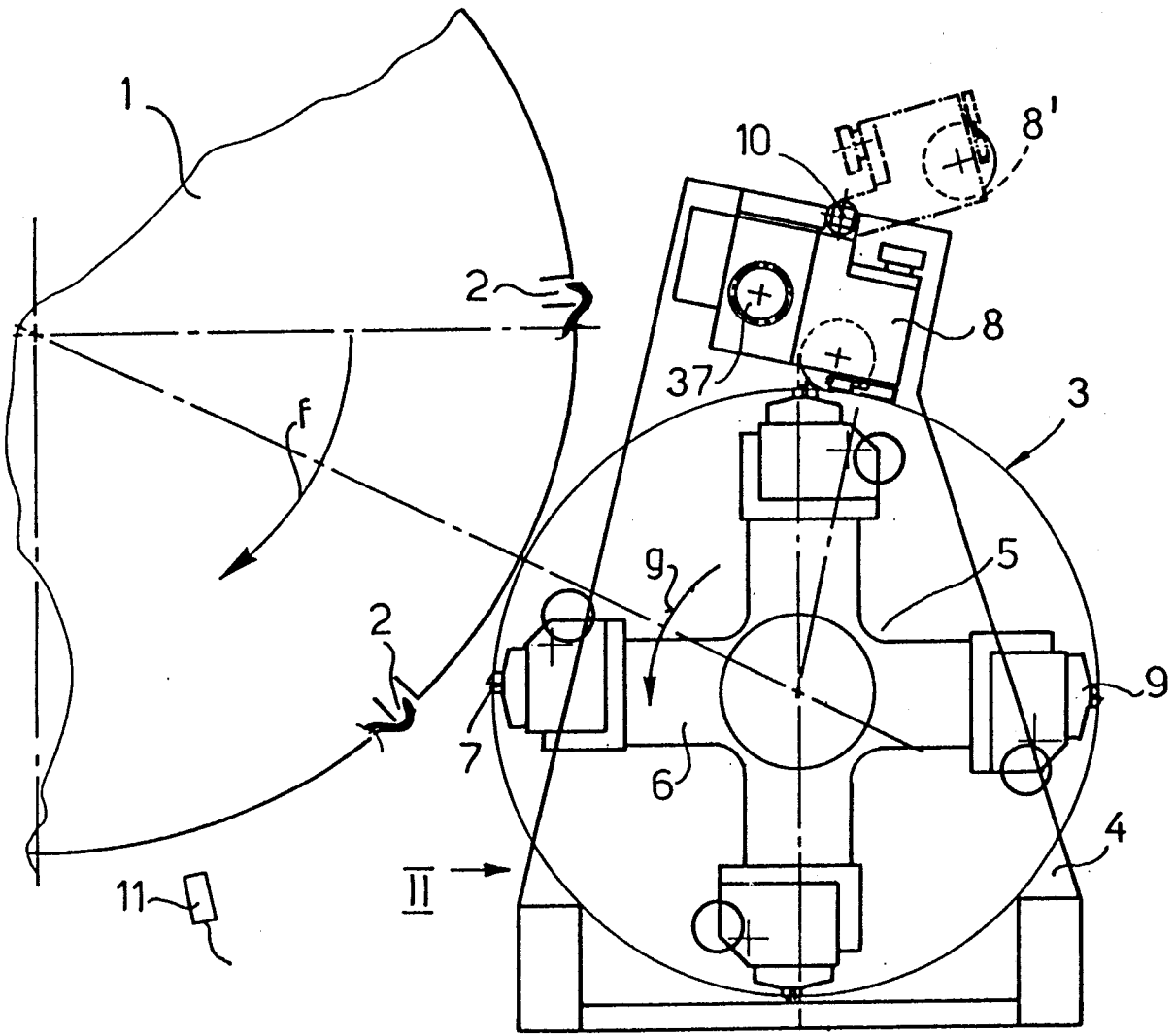
FIG. 1 is a fragmentary schematic elevational view of an apparatus which embodies one form of the invention.

FIG. 1 shows a transporting unit including a substantially drum- or wheel-shaped conveyor 1 which is indexible stepwise or continuously rotatable about a substantially horizontal axis and has equidistant peripheral grippers or analogous means for holding groups 2 of overlapping sheets (e.g., groups of signatures) so that the backs of the sheets in each group are ready to receive pairs of staples in order to convert the signatures into brochures, pamphlets, magazines or like products. The means for driving the conveyor 1 in the direction of arrow f is not specifically shown in the drawing. The conveyor 1 can be driven at a speed such that the apparatus can turn out up to and even in excess of 50,000 brochures or the like per hour. The exact construction of the conveyor 1 and of its means for holding the groups 2 of signatures or the like is known in the art.

The means for converting the groups 2 of sheets into brochures or the like comprises a staple applying unit 3 which is adjacent a portion of the path of travel of groups 2 with the conveyor 1. The unit 3 comprises a frame having two upright frame members a cruciform carrier 5 with four substantially radially extending arms 6. The carrier 5 is rotatable or indexible in the direction of arrow g (FIG. 2), and the angular movements of the carrier 5 are synchronized with angular movements of the conveyor 1 in such a way that the radially outermost portions of successive arms 6 come nearest to the periphery of the conveyor 1 (i.e., to the path of movement of the groups 2) when such arms are immediately adjacent the oncoming groups 2. The means for supplying groups 2 of sheets to successive holders of the conveyor 1 can be located at the 11, 12, 1, 2 or any other o'clock position as long as such feeding means does not interfere with the application of staples and as long as each holder which approaches the stapling station (substantially at the four o'clock position of the conveyor 1 in FIG. 1) carries a group 2 of signatures with or without covers or the like.

The arms 6 of the carrier 5 carry sets of three staple applying heads. Each set includes two heads 7 and an additional or auxiliary head 7'.

The upper end portions of the frame members 4 mount a horizontal support in the form of a shaft 10 which is parallel to the shaft of the carrier 5. The shaft 10 carries three wire feeding devices including two normally operative or active outer wire feeding devices 8 and a normally inactive wire feeding device 8'. Each of the devices 8, 8' has a housing section which is pivotable about the axis of the shaft 10 between an operative position (note the position of the device 8 in FIG. 2) and an inoperative position (note the position of the device 8' in FIG. 2). The wire F (FIG. 4) is preferably a metallic wire which is supplied by a suitable source and is or can be stored on discrete reels or in barrels in a manner not forming part of the invention. The devices 8 and 8' can be designed to feed successive increments of the wire F for conversion (by the heads 7, 7') into substantially U-shaped staples which are applied by the heads 7, 7' and are clinched after their legs have penetrated through the sheets of the respective groups. The heads 7, 7' have suitable grippers or tongs 9 of conventional design which form U-shaped staples from wire which is fed by the respective devices 8, 8' and deliver the staples to the stapling station for application to the respective groups 2.

Under normal operating conditions, the wire feeding devices 8 are operative and the wire feeding device 8' between the devices 8 is inoperative. As mentioned above, each of the devices 8, 8' has a housing section which is movable to an inoperative position. To this end, the movable housing sections of the devices 8, 8' are secured to the shaft 10 by suitable screws (not shown) or by analogous fastener means which must be loosened in order to enable an operator to change the angular position of the movable housing section of the one or the other device 8, 8' and to thereupon fix the movable housing section of the selected device 8 or 8' in an inoperative position. The device 8 or 8' whose movable housing section is held in the inoperative position cannot supply wire F to the oncoming heads 7 or 7' which are provided on the arms 6 of the carrier 5. The inoperative devices 8 and 8' are readily accessible because the shaft 10 is mounted on and extends between the upper end portions of the frame members 4. The movable housing section of a selected device 8 or the device 8' will be moved to inoperative position for the purposes of inspection, repair and/or replacement of its parts. Furthermore, the movable housing section of one of the devices 8 can be moved to inoperative position if the total number of devices 8 exceeds the number of staples which should be applied to certain groups 2 of sheets or the like. The inoperative devices 8 or the inoperative device 8' can be attended to while the apparatus continues to convert groups 2 of sheets and staples into brochures or the like. The conveyor 1 can receive groups 2 of sheets or signatures from one or more rotary printing presses, not shown. Such printing presses may be of the type manufactured and distributed by the assignee of the present application.

Figure 2:
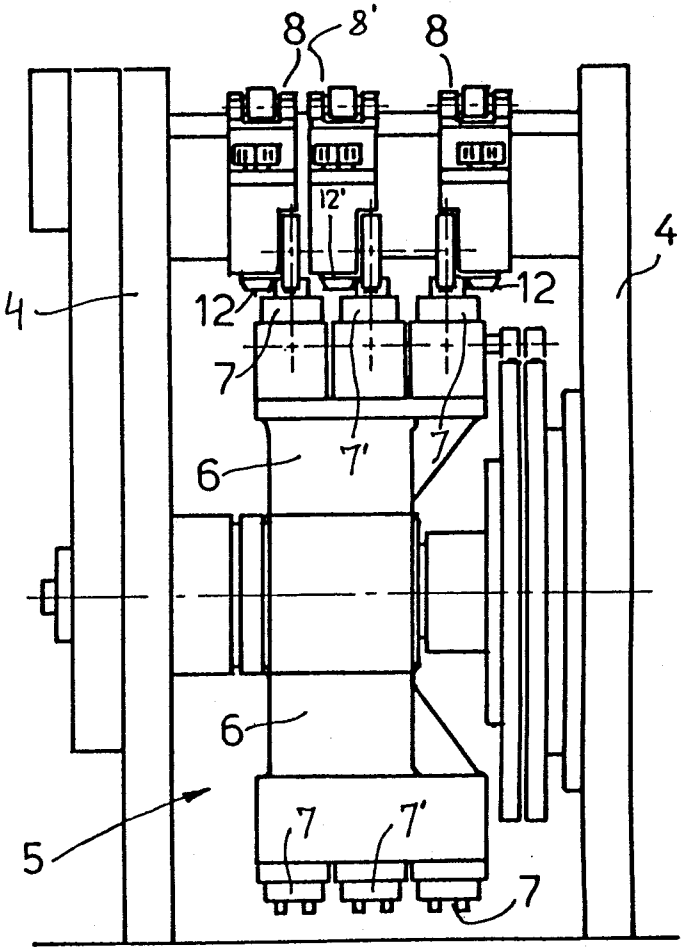
FIG. 2 is an end elevational view of the frame for the staple applicators as seen in the direction of arrow II in FIG. 1.

The apparatus further comprises suitable monitoring means 11 (e.g., in the form of proximity detectors, optical detectors or combinations of two or more different detectors) for ascertaining the presence of staples in the groups 2 which advance beyond the stapling station. FIG. 1 shows a proximity detector 11 at a level below the horizontal axis of the conveyor 1. The purpose of this monitoring device is to generate signals denoting the absence of staples in those portions of successive groups 2 which should have received staples from the heads 7 cooperating with the two outer wire feeding devices 8. FIG. 2 shows that the apparatus comprises two monitoring devices 11, one for each of the wire feeding devices 8, and the outputs of the monitoring devices 11 are connected to the corresponding inputs of a microprocessor 13 which serves as a means for evaluating and processing the incoming signals and for transmitting signals via outputs 14. The signals are used to activate or deactivate the wire feeding device 8', namely to activate the device 8' when one of the devices 8 is out of commission so that each group 2 continues to receive the same number of staples as before except that the locations of staples which are applied by the heads 7' cooperating with the wire feeding device 8' deviate from those of the staples which are normally applied by the heads 7 cooperating with the temporarily deactivated device 8.

Wires F which are supplied to the wire feeding devices 8 are advanced by pairs of driven rollers 12 shown in the upper portion of FIG. 2. Wires F which are supplied by the pairs of rollers 12 to the two outer wire feeding devices 8 of FIG. 2 are deformed not later than during travel of the oncoming heads 7 past such devices 8 so that the tongs 9 of the heads 7 entrain U-shaped staples which are ready for application to the oncoming groups 2 of sheets at the stapling station. Each wire feeding device 8 cooperates with means for severing the respective wire F (such severing means are provided on the heads 7) so that the leaders of the wires F are converted into discrete U-shaped staples which are held by the tongs 9 of the heads 7 and are transported to the stapling station.

The centrally located auxiliary wire feeding device 8' can be held in the same position as the two outer wire feeding devices 8 (insofar as the angular position of its movable housing section 108 with reference to the shaft 10 is concerned). However, when the devices 8 are operative, the device 8' does not receive any wire from the respective reel or barrel so that the median heads 7' on the arms 6 of the carrier 5 cannot receive staples during travel past the shaft 10, i.e., the applicator means including the heads 7' and the wire feeding device 8' is normally inactive. The wire supplying rollers 12' of the wire feeding device 8' are set in motion only in response to signals from the microprocessor 13, namely in response to signals which denote that one or the other of the two outer wire feeding devices 8 has failed to supply wire to the respective heads 7.

Figure 3:
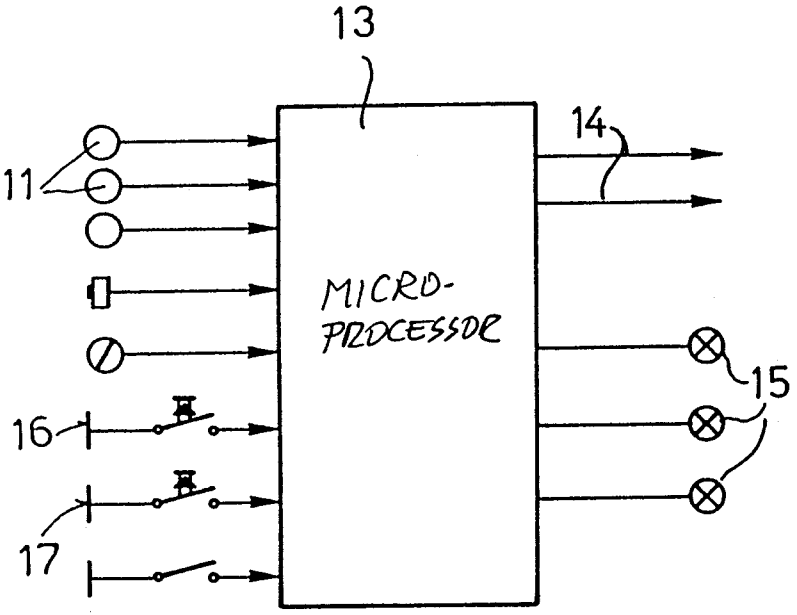
FIG. 3 is a diagrammatic view of actuating means for the applicator means.

FIG. 3 shows that the microprocessor 13 can receive and process several signals in addition to those which are supplied by one or both monitoring devices 11. The arrangement may be such that the microprocessor 13 arrests the entire apparatus if each of the monitoring devices 11 transmits a signal, i.e., when each of the wire feeding devices 8 is out of commission. The microprocessor 13 can be replaced by a smaller data processing unit which is operated with cards or by any other means which is capable of rapidly and reliably processing signals supplied by the monitoring devices 11 and of adequately controlling the operation of the auxiliary applicator means including the median heads 7′ on the arms 6 and the auxiliary wire feeding device 8′ on the shaft 10. The monitoring devices 11 can be designed to transmit signals in response to detection of staples in successive groups 2 or to transmit signals in response to detected absence of staples. All that counts is to ensure that the outputs 14 of the microprocessor 13 can transmit signals which activate the drive for the rollers 12′ and enable the auxiliary device 8′ to supply wire to successive heads 7′ when the one or the other of the two outer wire feeding devices 8 is inoperative or when its operation is unsatisfactory.

Figure 4:
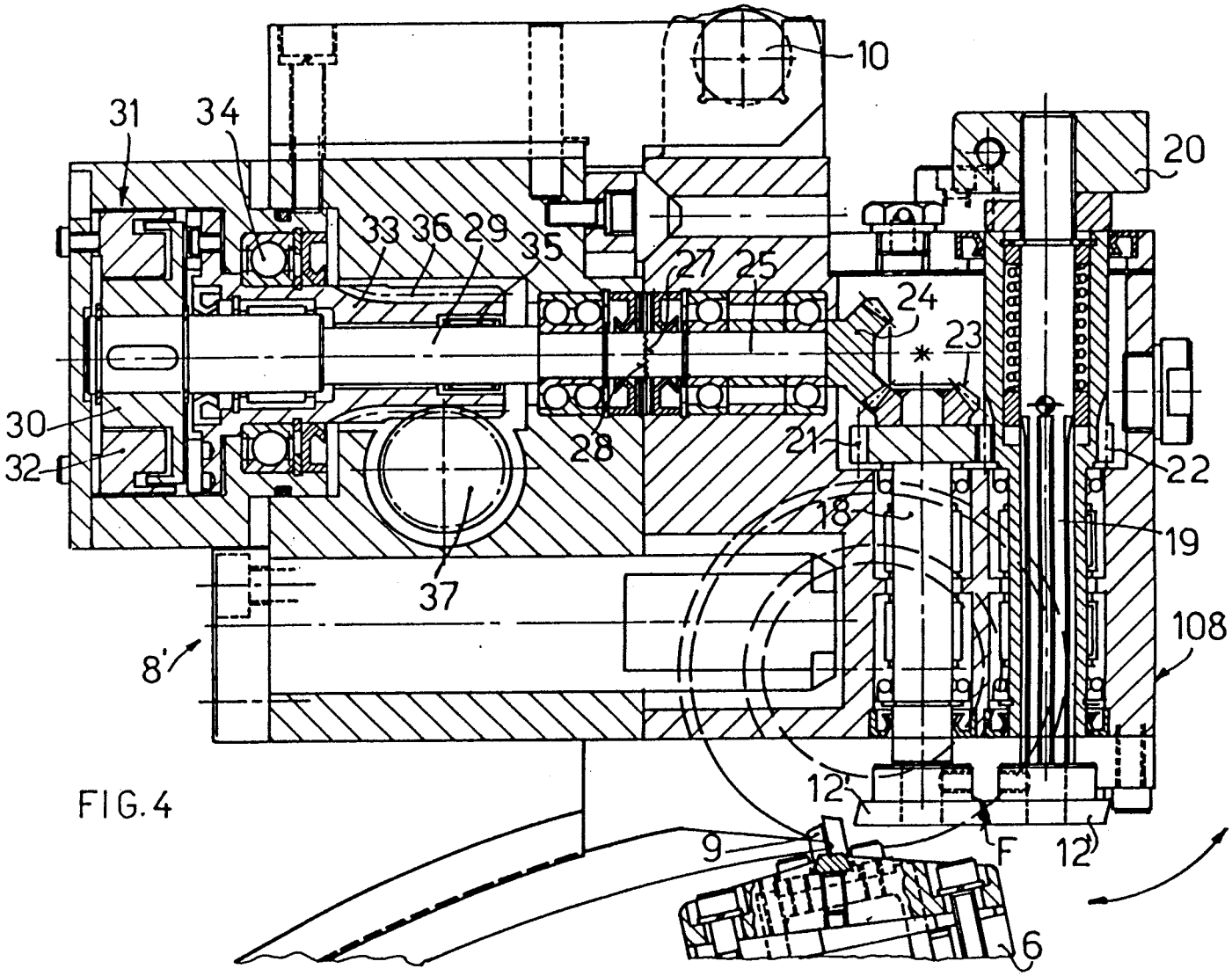
FIG. 4 is an enlarged sectional view of a detail in the structure of FIG. 2.

The rollers 12′ which supply wire to the device 8′ receive torque in response to engagement of a normally disengaged electromagnetic clutch 31 which is shown in FIG. 4. The clutch 31 is installed in the stationary section of the housing of the wire feeding device 8′.

The main control panel (not shown in detail) of the apparatus including the conveyor 1 and the staple applying unit 3 (such apparatus can constitute a production line further including one or more rotary printing presses which supply sheets or signatures to the conveyor 1 and means for stacking and/or otherwise processing products which are formed on the conveyor 1) preferably carries additional signal generating and transmitting elements some of which are shown in FIG. 3. For example, the control panel can carry a set of lamps 15 which constitute a signal displaying means and light up when the corresponding wire feeding devices 8, 8′ are operative or inactive. Thus, each of the three lamps 15 is connected with one of the devices 8, 8′, 8 and lights up when the corresponding wire feeding device is idle or operates at less than normal speed or is defective for other reasons. The operators are then informed that one of the devices 8 or the device 8′ requires inspection, repair or replacement. This is effected in the aforediscussed manner, i.e., by changing the orientation of the movable housing section of the affected wire feeding device relative to the axis of the shaft 10 so that the device is readily accessible for inspection by an attendant. If one of the devices 8 is defective, the processor 13 generates one or more signals which are used to activate the device 8′. If the device 8′ is defective simultaneously with one of the devices 8, the processor 13 will or can transmit a signal which stops the entire apparatus.

If the display means including the lamps 15 indicates the defectiveness of one of the devices 8, such device is repaired or replaced while the apparatus operates with the other device 8 and with the auxiliary device 8′, and the movable housing section of the repaired device 8 is returned to the operative position as soon as the repair or replacement work is completed. The operator then actuates a reset key 16 which generates a signal to cause a disengagement of the aforediscussed clutch 31 in the housing of the device 8′ and a starting of the rollers 12 for the repaired or replaced device 8 so that the apparatus then operates with the two devices 8 while the device 8′ is idle.

The control panel further carries a key 17 which can be depressed to deactivate one of the devices 8 and to simultaneously activate the device 8′. The key 17 will be depressed when an operator wishes to replenish the supply of wire F for one of the devices 8 without bringing the apparatus to a halt. It will be readily appreciated that even minor interruptions in the operation of a production line which turns out up to or more than 50,000 publications per hour can entail huge losses in output.

FIG. 4 shows the details of the wire feeding device 8′. Basically, the construction of the device 8′ is analogous or practically identical to the operation of the devices 8. The lower portion of FIG. 4 shows tongs 9 provided on the respective arm 6 and forming part of one of the heads 7, 7′ to transfer a freshly formed U-shaped staple to the stapling station at or close to the four o'clock position of the conveyor 1 shown in FIG. 1. The metallic wire F (coming from a reel or from a barrel) is fed into the nip of two neighboring rollers 12′ which are adjacent to the path of orbital movement of a set of tongs 9, and the oncoming tongs 9 engage, sever and deform the wire to form a U-shaped staple which is thereupon transported to the stapling station.

The housing of the device 8′ which is shown in FIG. 4 comprises a movable portion or section 108 which is pivotable on the shaft 10 and carries shafts 18, 19 for the rollers 12′. The shaft 19 is adjustable by a device 20 in a manner and for the purposes forming no part of the present invention.

The upper end portion of the shaft 18 carries a spur gear 21 mating with a spur gear 22 of the shaft 22. The shaft 18 further carries a bevel gear 23 in mesh with a bevel gear 24 at the adjacent end of a shaft 25 which is journalled in the section 108 of the housing of the device 8′ of FIG. 4. The left-hand end portion of the shaft 25 has an end face provided with radially extending teeth 27 adapted to mesh with complementary teeth 28 on a shaft 29 which is coaxial with the shaft 25. The shaft 29 is mounted in the stationary housing section of the device 8′. The left-hand end portion of the shaft 29 carries one half (30) of the electromagnetic clutch 31. The other half 32 of the clutch 31 is connected with a sleeve 33 which is rotatably mounted in an antifriction ball bearing 34 installed in the stationary section of the housing of the device 8′. A needle bearing 35 is interposed between the sleeve 33 and the shaft 29. The sleeve 33 is rotatably mounted in the stationary section of the housing and has an external worm wheel 36 meshing with a worm 37 which extends through the stationary section of the housing of the device 8′ as well as through the stationary housing sections of the devices 8 on the shaft 10 so that it can change the angular positions of three sleeves 33, two in the housings of the devices 8 and the third in the stationary section of the housing of the device 8′. The means (not shown) for rotating the worm 37 can comprise a reversible electric motor or rotary part of the apparatus including the structure of FIGS. 1 to 4.

When the electromagnetic clutch 31 is not energized, the sleeve 36 merely rotates in the bearings 34, 35 in the stationary section of the housing of the device 8′. The shaft 29 is not driven and this shaft cannot rotate the shafts 18, 19 (through the medium of the shaft 25, bevel gears 24, 23 and spur gears 21, 22). Thus, the rollers 12′ are idle and cannot supply wire F to the oncoming tongs 9 of heads 7′ on successive arms 6 of the carrier 5. The clutch 31 is energized in response to signals at the outputs 14 of the microprocessor 13 (i.e., in response to detected failure of one of the devices 8 to feed wire to the associated tongs 9) and the shaft 25 receives torque from the worm 37 via worm wheel 36, sleeve 36 and shaft 29 so that the shafts 18, 19 rotate the respective rollers 12′ and the oncoming tongs 9 receive requisite lengths of wire F during each travel past the device 8′ of FIG. 4.

The exact manner in which the teeth 26 are disengaged from the teeth 27 before the housing section 108 is pivoted about the axis of the shaft 10 forms no part of the invention.

The number of additional or auxiliary staple applicator means can be increased to two or more, depending on the number of the primary or regular applicator means. For example, if the shaft 10 carries three wire feeding devices 8, the apparatus can comprise two additional wire feeding devices 8' and two additional sets of oribiting heads 7', one set for each of the wire feeding devices 8'.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for applying staples to groups of sheets, comprising means for transporting a series of groups of sheets along a predetermined path; first staple applicator means arranged to apply staples to successive groups of sheets on said transporting means; second staple applicator means actuatable to apply staples to successive groups of sheets on said transporting means; means for monitoring the groups on said transporting means and for generating signals in response to detected failure of said first applicator means to apply staples to the groups on said transporting means; and means for actuating said second applicator means in response to said signals.

2. The apparatus of claim 1, wherein said transporting means comprises a rotary conveyor.

3. The apparatus of claim 1, wherein said first applicator means comprises a plurality of applicator heads each arranged to apply a staple to successive groups of sheets on said transporting means and means for feeding wire to said heads, said monitoring means including means for generating signals denoting the failure of at least one of said heads to apply staples to the groups of sheets on said transporting means.

4. The apparatus of claim 3, wherein said second applicator means comprises a single wire feeding device.

5. The apparatus of claim 1, wherein said applicator means comprise staple applying heads and means for feeding metallic wire to said heads.

6. The apparatus of claim 5, further comprising a substantially horizontal support for said feeding means, at least one of said feeding means having a section movable relative to said support between an operative position in which the respective head can receive wire and an inoperative position in which the respective head cannot receive wire from the associated wire feeding means.

7. The apparatus of claim 1, wherein said transporting means comprises a conveyor which is rotatable about a substantially horizontal axis and said monitoring means includes at least one detector adjacent said conveyor at a level below said axis.

8. The apparatus of claim 1, wherein said monitoring means comprises at least one proximity detector.

9. The apparatus of claim 1, wherein said monitoring means comprises at least one optical detector.

10. The apparatus of claim 1, wherein said actuating means comprises a microprocessor having input means connected with said monitoring means and output means connected with said second applicator means.

11. The apparatus of claim 1, further comprising means for selectively interrupting the operation of at least one of said applicator means.

12. The apparatus of claim 1, wherein said second applicator means comprises at least one wire applying head and means for feeding wire to said head, said actuating means comprising means for actuating said wire feeding means in response to said signals.

13. The apparatus of claim 1, further comprising means for selectively deactivating said first applicator means and display means including means for indicating the condition of said applicator means.

14. The apparatus of claim 1, wherein said actuating means includes means for starting and interrupting the operation of said first applicator means.

15. The apparatus of claim 1, wherein at least one of said applicator means comprises at least one staple applying head and means for feeding wire to said head, said feeding means including a section which is pivotable about a substantially horizontal axis between an inoperative position in which the feeding of wire to said head is interrupted and an operative position in which said feeding means is actuatable by said actuating means to supply wire to said head.

16. The apparatus of claim 15, wherein said feeding means includes a second section and said torque transmitting means includes a second shaft rotatably mounted in said second section, said shafts having teeth which mate in the operative position of said pivotable section.

17. The apparatus of claim 15, wherein said feeding means includes a rotary shaft which is mounted in said movable section, at least one wire feeding roller arranged to be driven by said shaft, a prime mover, and means for transmitting torque from said prime mover to said shaft in response to said signals in the operative position of said section.

18. The apparatus of claim 17, wherein said torque transmitting means comprises an electromagnetic clutch which is energizable in response to said signals to connect said prime mover with said shaft.

19. The apparatus of claim 17, wherein said prime mover comprises a driven worm and said torque transmitting means comprises a worm wheel mating with said worm and a clutch which is interposed between said worm wheel and said shaft and is engageable in response to said signals.

20. The apparatus of claim 19, wherein each of said applicator means comprises at least one wire feeding means and said worm is common to the feeding means of all of said applicator means.

* * * * *